US009649757B2

(12) United States Patent
Hecht et al.

(10) Patent No.: US 9,649,757 B2
(45) Date of Patent: May 16, 2017

(54) HAMMER MECHANISM

(75) Inventors: Joachim Hecht, Magstadt (DE); Heiko Roehm, Stuttgart (DE); Martin Kraus, Filderstadt (DE)

(73) Assignee: Robert Bosch GMBH, Stuttgart (DE)

( * ) Notice: Subject to any disclaimer, the term of this patent is extended or adjusted under 35 U.S.C. 154(b) by 909 days.

(21) Appl. No.: 13/989,247

(22) PCT Filed: Oct. 14, 2011

(86) PCT No.: PCT/EP2011/067976
§ 371 (c)(1),
(2), (4) Date: Aug. 5, 2013

(87) PCT Pub. No.: WO2012/072329
PCT Pub. Date: Jun. 7, 2012

(65) Prior Publication Data

US 2013/0299206 A1 Nov. 14, 2013

(30) Foreign Application Priority Data

Nov. 29, 2010 (DE) ..... 10 2010 062 107

(51) Int. Cl.

| | |
|---|---|
| ***B25D 17/06*** | (2006.01) |
| ***B25D 17/08*** | (2006.01) |
| ***B25B 21/02*** | (2006.01) |
| ***B25D 11/06*** | (2006.01) |
| ***B25D 16/00*** | (2006.01) |
| ***B25F 5/00*** | (2006.01) |

(52) U.S. Cl.
CPC ..... *B25D 17/084* (2013.01); *B25B 21/023* (2013.01); *B25D 11/062* (2013.01); *B25D 16/00* (2013.01); *B25D 17/06* (2013.01); *B25F 5/001* (2013.01); *B25D 2216/003* (2013.01); *B25D 2216/0023* (2013.01); *B25D 2217/0015* (2013.01); *B25D 2217/0019* (2013.01); *B25D 2250/301* (2013.01)

(58) Field of Classification Search
CPC ..... B25D 15/02; B25D 17/084
USPC ..... 173/104, 48, 93, 93.5
See application file for complete search history.

(56) References Cited

U.S. PATENT DOCUMENTS

| | | | | |
|---|---|---|---|---|
| 3,741,313 A * | 6/1973 | States | B25B 23/1453 | 173/176 |
| RE33,733 E * | 11/1991 | Hendrikx | B25D 11/005 | 173/109 |
| 5,366,025 A * | 11/1994 | Dutschk | B25D 11/005 | 173/109 |
| 6,158,526 A * | 12/2000 | Ghode | B25B 21/026 | 173/109 |

(Continued)

FOREIGN PATENT DOCUMENTS

DE 42 41 000 6/1994

OTHER PUBLICATIONS

International Search Report for PCT/EP2011/067976, dated Dec. 16, 2011.

*Primary Examiner* — Andrew M Tecco
*Assistant Examiner* — Praachi M Pathak
(74) *Attorney, Agent, or Firm* — Gerard Messina

(57) ABSTRACT

A hammer mechanism has a clamping chuck and a snap die provided for the direct striking of an inserted tool. The snap die includes a coupling element for transmitting a rotary motion to the clamping chuck.

16 Claims, 8 Drawing Sheets

(56) References Cited

U.S. PATENT DOCUMENTS

| | | | | |
|---|---|---|---|---|
| 7,124,839 | B2 * | 10/2006 | Furuta | B25B 21/026 173/104 |
| 9,211,639 | B2 * | 12/2015 | Hecht | B25D 11/062 |
| 2005/0028995 | A1 * | 2/2005 | Saito | B25D 17/24 173/176 |
| 2009/0078468 | A1 * | 3/2009 | Paasonen | B25D 16/00 175/322 |

* cited by examiner

HAMMER MECHANISM

BACKGROUND OF THE INVENTION

1. Field of the Invention

The present invention relates to a hammer mechanism for a hand tool.

2. Description of the Related Art

A hammer mechanism including a clamping chuck and a snap die provided for the direct striking of an inserted tool are already known.

BRIEF SUMMARY OF THE INVENTION

The present invention relates to a hammer mechanism which includes a clamping chuck and a snap die provided to directly strike an inserted tool.

It is proposed to equip the snap die with a coupling means for transmitting a rotary motion to the clamping chuck. The snap die advantageously transmits a rotary motion of a clamping chuck drive shaft to the clamping chuck. The term "clamping chuck" in particular describes a device for the direct mounting of an inserted tool in at least torsionally fixed manner, such that a user is able to be remove it, especially without employing a tool. A "snap die" in particular means an element of the hammer mechanism which during an impact-drilling operation transmits a strike pulse from the hammer means of the hammer mechanism in the direction of the inserted tool. In at least one operating state, the snap die preferably hits the inserted tool directly. The snap die preferably prevents dust from penetrating the hammer mechanism through the clamping chuck. "Provided" in particular means specially configured and/or equipped. An "inserted tool" in particular refers to a means that acts directly on a workpiece during a working step. In an operative state, the inserted tool preferably is connected to the clamping chuck, particularly in reversible manner without using a tool. "Coupling means" in particular describes a means for transmitting a motion from one component to another component through at least one keyed connection. The keyed connection preferably is developed in such a way that a user is able to release it in at least one operating state. In an especially preferred manner, the keyed connection is releasable for a switch between operating modes, i.e., advantageously between a screwing, drilling, cutting and/or an impact drilling operation. The coupling means in particular is developed in the form of a coupling considered useful by the expert, but advantageously as a dog clutch and/or toothing. The coupling means advantageously includes a plurality of keyed connection elements and a region that connects the keyed connection elements. The development according to the present invention makes it possible to provide an especially compact hammer mechanism.

In addition, the clamping chuck includes a coupling region for an inserted tool, with which region the coupling means of the snap die engages at least partially, so that an especially minimal construction outlay is achievable. A "coupling region for an inserted tool" in particular means a region of the clamping chuck whose form and dimensions in a plane perpendicular to an axis of rotation of the clamping chuck are the same as those of a region provided for the direct and torsionally fixed mounting of the inserted tool.

It is furthermore provided that the hammer mechanism includes a clamping chuck drive shaft to transmit a rotary motion to the snap die, so that an especially minimal space requirement is achievable by constructionally simple measures. Preferably, the clamping chuck drive shaft includes a coupling means, which in an operative state, produces a torsionally fixed and axially displaceable connection to a coupling means of the snap die. A "clamping chuck drive shaft" in particular denotes a shaft which during a drilling and/or impact drilling operation transmits a rotary motion from a gearing, especially a planetary gearing, in the direction of a clamping chuck. Preferably, the clamping chuck drive shaft is at least partially developed as solid shaft. The clamping chuck drive shaft preferably extends across at least 40 mm in the strike direction. In a drilling and/or impact drilling operation, the clamping chuck drive shaft and the clamping chuck preferably have the same rotational speed at all times, i.e., no gear unit is provided on a drive train between the clamping chuck drive shaft and the clamping chuck.

In one advantageous embodiment of the present invention, the clamping chuck drive shaft is at least partially situated within a recess of the snap die in at least one operating state, so that a compact and uncomplicated construction is possible.

In another development, the snap die includes a sealing region which rests against the clamping chuck without gear teeth and thereby makes it possible to achieve especially effective sealing from dust that may penetrate a coupling region of the inserted tool. A "sealing region" in particular means a region of the snap die that provides sealing from dust, contamination and moisture between the snap die and the clamping chuck. "Without gear teeth" in particular means that the sealing region in particular has no coupling means which transmits the rotary motion.

Furthermore, the hammer mechanism includes a strike means which is supported by the clamping chuck drive shaft in a manner allowing movement in the strike direction in at least one operating state, so that low weight and a small size are obtainable. A "strike means" in particular denotes a means of the hammer mechanism which is meant to be accelerated during operation by an impact-generation unit, especially in translatory fashion, and to output a pulse, picked up during the acceleration, in the direction of the inserted tool in the form of a strike pulse. The strike means preferably is supported by air pressure or, advantageously, by a rocker lever, in such a way that it is able to be accelerated in the strike direction. Prior to a strike, the strike means preferably is in a non-accelerated state. During a strike, the strike means outputs a strike pulse in the direction of the inserted tool, in particular via a snap die. A "strike direction" in particular denotes a direction that is oriented parallel to an axis of rotation of the clamping chuck and runs from the strike means in the direction of the clamping chuck. The strike direction preferably is aligned parallel to an axis of rotation of the clamping chuck drive shaft. The term "support so as to allow movement" specifically means that the clamping chuck drive shaft has a bearing surface which in at least one operating state transmits bearing forces to the strike means, in a direction perpendicular to the strike direction.

Furthermore, the clamping chuck drive shaft penetrates the strike means at least partially, so that a clamping chuck drive shaft having an especially low mass and requiring little space is able to be provided. The phrase "penetrates at least partially" in particular means that the strike means encloses the clamping chuck drive shaft over more than 270 degrees, advantageously 360 degrees, in at least one plane which advantageously is oriented perpendicularly to the strike direction. The strike means preferably is affixed on the clamping chuck drive shaft in form-fitting manner in a direction perpendicular to the axis of rotation of the clamping chuck drive shaft, i.e., mounted in a manner that allows movement in the direction of the axis of rotation.

Moreover, the hammer mechanism includes an impact-generation deactivation unit provided with a blocking element; this blocking element acts on the snap die, parallel to at least a force of the clamping chuck drive shaft, in at least a drilling and especially in a screwing operation, so that an advantageous placement of the operating element of the impact-generation deactivation unit is possible using constructionally uncomplicated measures. In particular, a circular operating element which encloses the snap die or the clamping chuck drive shaft is easy to realize. In addition, this development requires little space. An "impact-generation deactivation unit" in particular is a unit which allows an operator to deactivate the impact-generation unit for a drilling and/or screwing operation. Preferably, the impact-generation deactivation unit prevents an especially automatic activation of the impact-generation unit while an inserted tool is pressed against a workpiece in a drilling and/or screwing mode. The pressure application in a cutting and/or impact drilling mode preferably causes an axial displacement of the clamping chuck drive shaft. In an advantageous manner, the blocking element prevents an axial displacement of the clamping chuck drive shaft, the clamping chuck and/or advantageously, the snap die in the drilling and/or screwing mode. "Parallel to a force" in particular means that in at least one operating mode, the clamping chuck drive shaft and the blocking element apply a force to the snap die at two different locations. As an alternative or in addition, the clamping chuck drive shaft and the blocking element are able to exert a force on the clamping chuck at two different locations in at least one operating state. The forces preferably have a component aligned in the same direction, i.e., preferably parallel to the axis of rotation of the clamping chuck drive shaft, from the clamping chuck drive shaft in the direction of the clamping chuck. The blocking element preferably acts on the snap die directly, but especially preferably, at least by way of a clamping chuck bearing. Preferably, the clamping chuck drive shaft is acting on the snap die directly, and the snap die preferably transmits a rotary motion of the clamping chuck drive shaft to the clamping chuck.

In addition, the hammer mechanism includes a planetary gearing, which drives the clamping chuck drive shaft in at least one operating state, so that an advantageous translation is achievable in space-saving manner. Moreover, a torque restriction and a plurality of gear stages are realizable by simple design measures. A "planetary gearing" in particular means a unit having at least one planetary wheel set. A planetary wheel set preferably includes a sun gear, a ring gear, a planetary wheel carrier and at least one planetary wheel, which is guided along a circular path about the sun gear by the planetary wheel carrier. Preferably, the planetary gearing has at least two translation ratios between an input and an output of the planetary gearing, which are selectable by the operator.

In addition, the hammer tool includes an impact-generation unit as well as a coupling means which is connected to the clamping chuck drive shaft in torsionally fixed manner and drives the impact-generation unit, thereby realizing an especially compact and powerful hammer mechanism by employing constructionally uncomplicated measures. An "impact-generation unit" in particular describes a unit provided to translate a rotary motion into an especially translatory impact motion of the strike means suitable for a drilling or impact drilling operation. In particular, the impact-generation unit is developed as an impact-generation unit of the type considered useful by the expert, but preferably is implemented as a pneumatic impact-generation unit and/or, especially preferably, as an impact-generation unit having a rocker lever. A "rocker lever" in particular denotes a means which is mounted so as to allow movement about a pivot axis and which is provided to output power that has been picked up in a first coupling area, to a second coupling area. "In torsionally fixed manner" in particular means that the coupling means and the clamping chuck drive shaft are fixedly connected to each other in at least the circumferential direction, preferably in all directions, i.e., especially in all operating states. "Drive" in this context in particular means that the coupling means transmits kinetic energy, in particular rotational energy, to at least one region of the impact-generation unit. The impact-generation unit preferably uses this energy to drive the strike means. Because of the development according to the present invention, it is possible.

In addition, the hammer mechanism includes at least one bearing, which mounts the clamping chuck drive shaft in axially displaceable manner, thereby providing a simple means for deactivating the hammer mechanism. A "bearing" in this context specifically describes a device which mounts the clamping chuck drive shaft, especially in relation to a housing, in a manner that allows movement about the axis of rotation and an axial displacement. The phrase "axial displacement" in particular means that the bearing mounts the clamping chuck drive shaft is movable manner, especially relative to a housing, in a direction parallel to the strike direction. Preferably, a connection of the coupling means of the clamping chuck drive shaft driving the impact-generation unit is able to be severed by shifting the clamping chuck drive shaft in the axial direction.

Furthermore, the hammer mechanism includes a torque-restriction device for restricting a torque which is maximally transmittable via the clamping chuck drive shaft; this advantageously protects the operator, and the handheld tool is able to be used in a comfortable and safe manner for performing screwing operations. "Restrict" in this case in particular means that the torque-restriction device prevents an exceeding of the maximum torque adjustable by an operator. Preferably, the torque-restriction device opens a connection between a drive motor and the clamping chuck that is torsionally fixed during operation. As an alternative or in addition, the torque-restriction device may act on an energy supply of the drive motor.

It is furthermore provided that the impact-generation unit includes a spur gear transmission stage, which translates a rotational speed of the clamping chuck drive shaft into a higher rotational speed for an impact generation, thereby making it possible to achieve an especially advantageous ratio between the rotational speed and number of impacts of an inserted tool, in a space-saving and uncomplicated manner. A "spur-gear transmission stage" in particular denotes a system of especially two toothed wheel works engaging with one another, which are mounted so as to be rotatable about parallel axes. On a surface facing away from their axis, the toothed wheel works preferably have gear teeth. A "rotational speed for impact generation" in particular is a rotational speed of a drive means of the impact-generation unit that appears useful to the expert and which translates a rotary motion into a linear motion. The drive means of the impact-generation unit preferably is developed in the form of a wobble bearing or, especially preferably, as an eccentric element. "Translate" in this case means that there is a difference between the rotational speed of the clamping chuck drive shaft and the rotational speed for an impact generation. The rotational speed for the impact generation preferably is higher, advantageously at least twice as high as the rotational speed of the clamping chuck drive shaft. Especially preferably, a translation ratio between the rotational speed for impact generation and the rotational speed of the clamping chuck drive shaft is a non-integer ratio.

Moreover, a handheld tool is provided which includes a hammer mechanism according to the present invention. A "handheld tool" in this context in particular describes a handheld tool that appears useful to the expert, but preferably is a drilling machine, an impact drill, a screw driller, a boring tool and/or an impact drilling machine. The handheld tool preferably is developed as a battery-operated handheld tool, i.e., the handheld tool in particular includes coupling means provided to supply a drive motor of the handheld tool with electrical energy from a handheld tool battery pack connected to the coupling means.

DETAILED DESCRIPTION OF THE INVENTION

Figure 1:
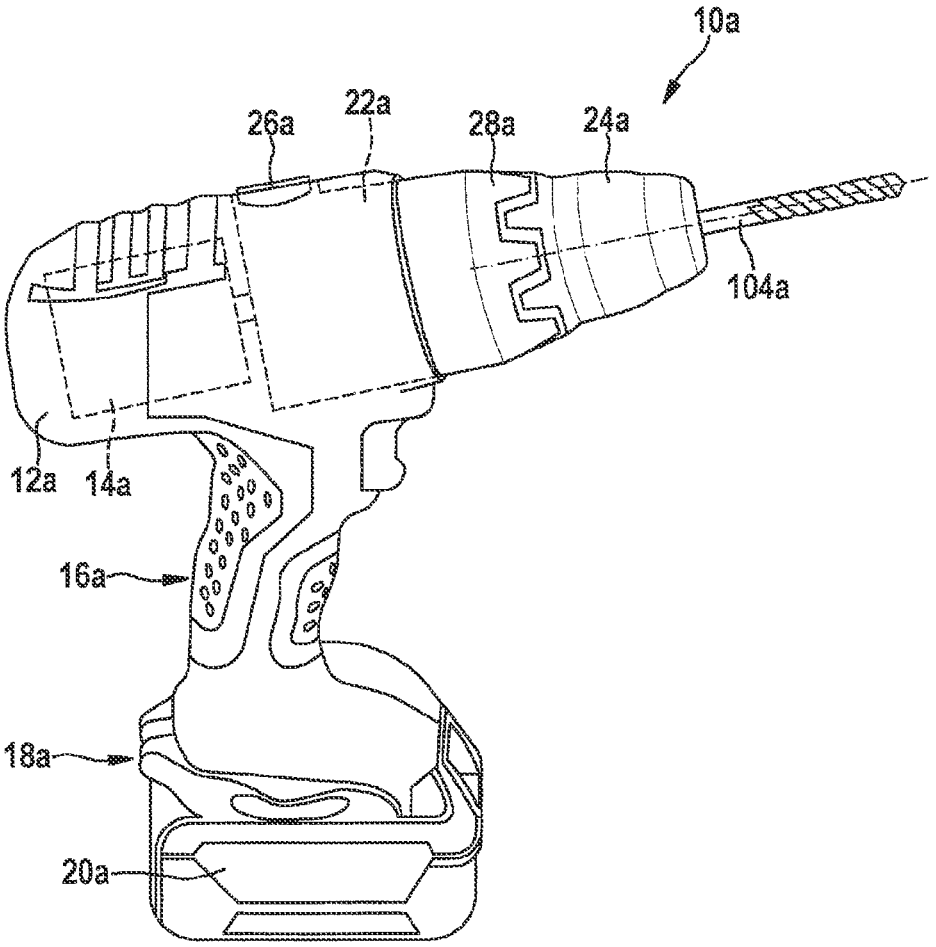
FIG. 1 shows a perspective view of a handheld tool having a hammer mechanism according to the present invention.

FIG. 1 shows a handheld tool 10*a*, which is developed as impact drill screwer. Handheld tool 10*a* has a pistol-shaped housing 12*a*. A drive motor 14*a* of handheld tool 10*a* is situated inside housing 12*a*. Housing 12*a* has a handle region 16*a* and a battery coupling means 18*a*, which is disposed at an end of handle region 16*a* facing away from drive motor 14*a*. Battery coupling means 18*a* links a handheld tool rechargeable battery 20*a*, which link is able to be severed by an operator, electrically or mechanically. Handheld tool battery 20*a* has an operating voltage of 10.8 Volt, but could also have a different operating voltage, especially a higher voltage. Furthermore, handheld tool 10*a* is provided with a hammer mechanism 22*a* according to the present invention, which includes a clamping chuck 24*a* disposed on the outside, and operating elements 26*a*, 28*a*.

Figure 2:
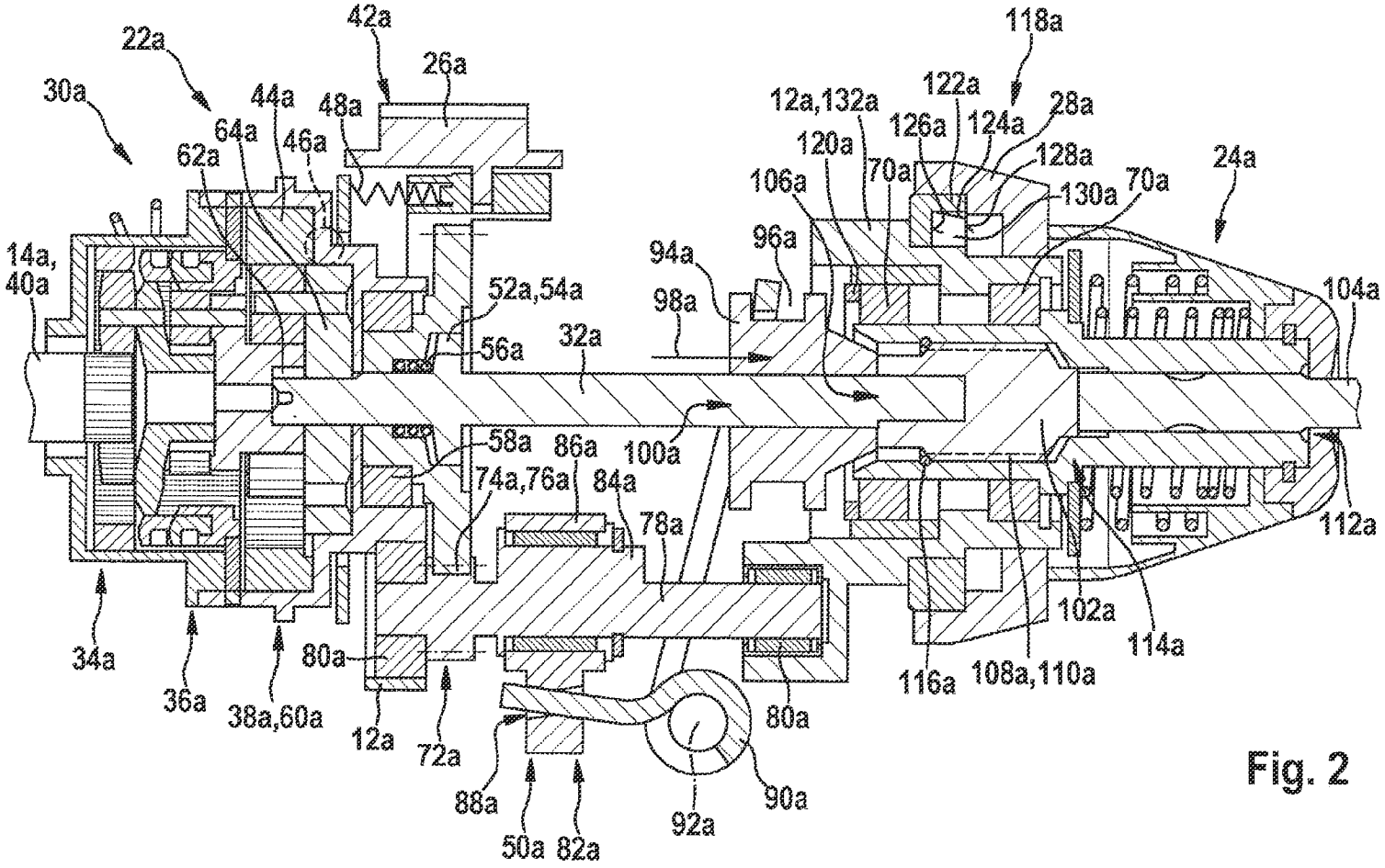
FIG. 2 shows a section of the hammer mechanism of FIG. 1.

FIG. 2 shows hammer mechanism 22*a* in a sectional view. Hammer mechanism 22*a* also includes a planetary gearing 30*a* and a clamping chuck drive shaft 32*a*. When in operation, planetary gearing 30*a* drives clamping chuck drive shaft 32*a* so that it executes rotary motions about an axis of rotation. Planetary gearing 30*a* has three planetary gear stages 34*a*, 36*a*, 38*a* for this purpose. The transmission ratio of planetary gearing 30*a* between a rotor 40*a* of drive motor 14*a* and a clamping chuck drive shaft 32*a* is adjustable in at least two stages by an operator. As an alternative, a transmission ratio between drive motor 14*a* and clamping chuck drive shaft 32*a* could also be designed to be non-adjustable.

Hammer mechanism 22*a* has a torque restriction device 42*a*, which fixates a ring gear 44*a* of planetary gearing 30*a* during a working operation. Torque restriction device 42*a* is provided with fixation balls 46*a* for this purpose, which engage with recesses of ring gear 44*a*. A spring 48*a* of torque restriction device 42*a* exerts a force in the direction of ring gear 44*a* on fixation balls 46*a*. Using one of operating elements 26*a*, the operator is able to move an end of spring 48*a* facing fixation balls 46*a* in the direction of fixation balls 46*a*. Operating element 26*a* includes an eccentric element for this purpose. The force acting on fixation balls 46*a* thus is adjustable. If a particular maximum torque has been reached, fixation balls 46*a* are pushed out of the recesses and ring gear 44*a* runs freely, thereby interrupting a force transmission between rotor 40*a* and clamping chuck drive shaft 32*a*. Torque restriction device 42*a* thus is provided to restrict a maximum torque that is transmittable via clamping chuck drive shaft 32*a*.

Figure 3:
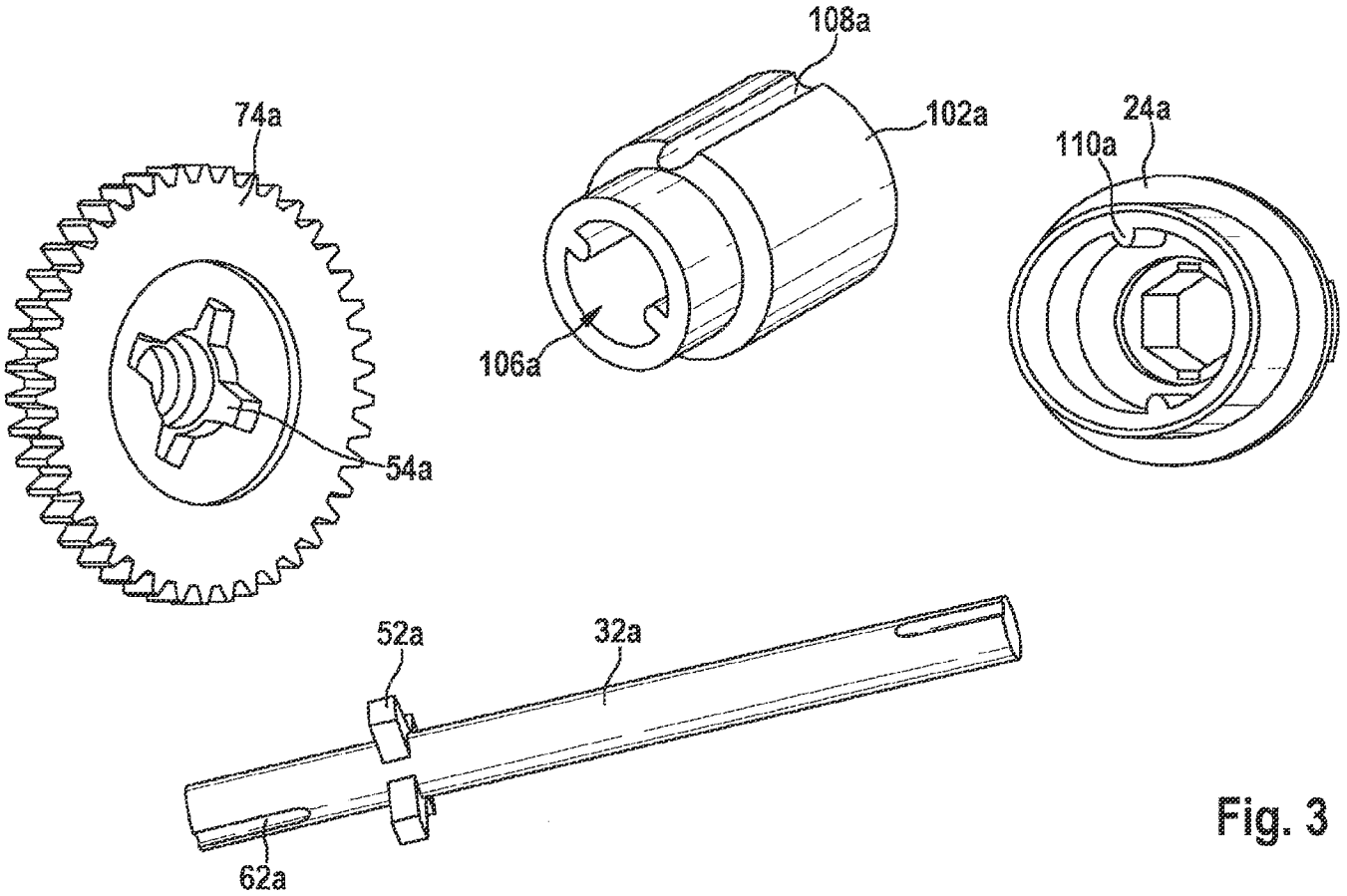
FIG. 3 shows coupling means, a clamping chuck drive shaft, a snap die, and a portion of a clamping chuck of the hammer mechanism from FIG. 1, shown individually in a perspective view in each case.

Hammer mechanism 22*a* includes an impact-generation unit 50*a* and first coupling means 52*a*. First coupling means 52*a* is connected to clamping chuck drive shaft 32*a* in torsionally fixed manner, i.e., first coupling means 52*a* and clamping chuck drive shaft 32*a* are formed in one piece, in particular. Impact-generation unit 50*a* includes a second coupling means 54*a*, which is connected to first coupling means 52*a* in torsionally fixed manner in a drilling and/or impact drilling mode. As shown in FIG. 3 as well, first coupling means 52*a* is developed as premolded shape and second coupling means 54*a* is developed as recess. When the drilling mode is activated, first coupling means 52*a* dips into second coupling means 54*a*, i.e., to the full extent. As a result, the coupling between first coupling means 52*a* and second coupling means 54*a* is reversible by axial shifting of clamping chuck drive shaft 32*a* in the direction of clamping chuck 24*a*. A spring 56*a* of hammer mechanism 22*a* is situated between first coupling means 52*a* and second coupling means 54*a*. Spring 56*a* pushes clamping chuck drive shaft 32*a* in the direction of clamping chuck 24*a*. When impact-generation unit 50*a* is deactivated, it opens the link between first coupling means 52*a* and second coupling means 54*a*.

Hammer mechanism 22*a* is provided with a first bearing 58*a*, which fixates second coupling means 54*a* relative to housing 12*a* in the axial direction and rotationally mounts it coaxially with clamping chuck drive shaft 32*a*. Furthermore, hammer mechanism 22*a* is provided with a second bearing 60*a*, which rotationally mounts clamping chuck drive shaft 32*a* on a side facing drive motor 14*a*, so that it is able to rotate about the axis of rotation. Second bearing 60*a* is integrally formed with one of the three planetary gear stages 38*a*. Clamping chuck drive shaft 32*a* has a coupling means 62*a*, which connects it to a planet carrier 64*a* of this planetary gear stage 38*a* in axially displaceable and torsionally fixed manner. This planetary gear stage 38*a* consequently is provided to mount clamping chuck drive shaft 32*a* in axially displaceable manner. On a side facing clamping chuck 24*a*, a clamping chuck bearing rotationally mounts clamping chuck drive shaft 32*a* together with clamping chuck 24*a*. Clamping chuck bearing 70*a* includes a rear bearing element which is pressed onto clamping chuck 24*a* in axially fixated manner. In addition, clamping chuck bearing 70*a* has a front bearing element which supports clamping chuck 24*a* inside housing 12*a* in axially displaceable manner.

Impact-generation unit 50*a* is equipped with a spur gear transmission stage 72*a*, which translates a rotational speed of clamping chuck drive shaft 32*a* into a higher rotational speed for the impact generation. A first toothed wheel 74*a* of spur gear transmission stage 72*a* is integrally formed with second coupling means 54*a*. In an impact-drilling operation, it is driven by clamping chuck drive shaft 32*a*. A second toothed wheel 76*a* of spur gear transmission stage 72*a* is integrally formed with a hammer mechanism shaft 78*a*. An axis of rotation of hammer mechanism shaft 78*a* is situated next to the axis of rotation of clamping chuck drive shaft 32*a* in the radial direction. Impact-generation unit 50*a* includes two bearings 80*a*, which mount hammer mechanism shaft 78*a* in axially fixated, rotatable manner. Impact-generation unit 50*a* is provided with a drive means 82*a*, which translates a rotary motion of hammer mechanism shaft 78*a* into a linear motion. An eccentric element 84*a* of drive means 82*a* is integrally formed with hammer mechanism shaft 78*a*. An eccentric sleeve 86*a* of drive means 82*a* is mounted on eccentric element 84*a* with the aid of a needle roller bearing, in a manner that allows it to rotate relative to eccentric element 84*a*. Eccentric sleeve 86*a* has a recess 88*a*, which encloses a rocker lever 90*a* of impact-generation unit 50*a*.

Rocker lever 90*a* is pivotably mounted on a pivot axle 92*a* of impact-generation unit 50*a*, that is to say, it is able to pivot about an axis aligned perpendicularly to the axis of rotation of clamping chuck drive shaft 32*a*. An end of rocker lever 90*a* facing away from drive means 82*a* partially encloses a strike means 94*a* of hammer mechanism 22*a*. In so doing, the rocker lever engages in a recess 96*a* of strike means 94*a*, which is developed in the form of a ring. In an impact-drilling operation, rocker lever 90*a* exerts a force on strike means 94*a*, which accelerates it. While in operation, rocker lever 90*a* moves in a sinusoidal pattern. Rocker lever 90*a* has an elastic form. It has a spring constant between eccentric sleeve 86*a* and strike means 94*a* that is less than 100 N/mm and greater than 10 N/mm. In this exemplary embodiment, rocker lever 90*a* has a spring constant of approximately 30 N/mm.

Clamping chuck drive shaft 32*a* mounts strike means 94*a* so that it is movable in strike direction 98*a*. To do so, strike means 94*a* delimit a recess 100*a*. Clamping chuck drive shaft 32*a* penetrates strike means 94*a* through recess 100*a*. In so doing, strike means 94*a* encloses recess 100*a* over 360 degrees in a plane perpendicular to recess 100*a*. When operated, strike means 94*a* strikes a snap die 102*a* of hammer mechanism 22*a*, which is situated between an inserted tool 104*a* and strike means 94*a*. In an operative state, inserted tool 104*a* is fixed in place inside clamping chuck 24*a*. Clamping chuck 24*a* mounts snap die 102*a* in a manner that allows it to move parallel to strike direction 98*a*. In an impact-drilling operation, strike pulses originating from strike means 94*a* are transmitted to inserted tool 104*a* by snap die 102*a*.

Clamping chuck drive shaft 32*a* is connected to snap die 102*a* in axially movable and torsionally fixed manner. Snap die 102*a* delimits a recess 106*a* for this purpose. In an operative state, clamping chuck drive shaft 32*a* is partially situated inside recess 106*a* of snap die 102*a*. Clamping chuck drive shaft 32*a* is rotationally mounted via snap die 102*a*, clamping chuck 24*a* and clamping chuck bearing 70*a*. Clamping chuck 24*a* is driven in rotating manner via snap die 102*a*. For this purpose, clamping chuck 24*a* and snap die 102*a* each include coupling means 108*a*, 110*a*, which are provided to transmit the rotary motion to clamping chuck 24*a*. Coupling means 108*a* of snap die 102*a* is developed as a groove, whose main extension is situated parallel to strike direction 98*a*. Coupling means 108*a* extends along a radially outward-lying surface area of snap die 102*a*. Coupling means 110*a* of clamping chuck 24*a* is implemented as a protrusion that fits the groove.

Clamping chuck 24*a* includes an inserted-tool coupling region 112*a*, in which inserted tool 104*a* is fixated in strike direction 98*a* during a drilling or screwing operation, or in which it is mounted so as to allow movement in strike direction 98*a* during an impact-drilling operation. In addition, the clamping chuck includes a tapered region 114*a*, which delimits a movement range of snap die 102*a* in strike direction 98*a*. Furthermore, clamping chuck 24*a* is provided with a mounting ring 116*a*, which delimits a movement range of snap die 102*a* counter to strike direction 98*a*.

During an impact-drilling operation, an operator presses inserted tool 104*a* against a workpiece (not shown further). The operator thereby shifts inserted tool 104*a*, snap die 102*a* and clamping chuck drive shaft 32*a* relative to housing 12*a* in a direction counter to the strike direction 98*a*, i.e., in the direction of drive motor 14*a*. In so doing, the operator compresses spring 56*a* of hammer mechanism 22*a*. First coupling means 52*a* dips into second coupling means 54*a*, so that clamping chuck drive shaft 32*a* begins to drive impact-generation unit 50*a*. When the operator stops pressing inserted tool 104*a* against the workpiece, spring 56*a* shifts clamping chuck drive shaft 32*a*, snap die 102*a* and inserted tool 104*a* in strike direction 98*a*. This releases a torsionally fixed connection between first coupling means 52*a* and second coupling means 54*a*, so that impact-generation unit 50*a* is switched off.

Hammer mechanism 22*a* has an impact-generation deactivation unit 118*a*, which includes a blocking element 120*a*, a sliding block guide 122*a*, and operating element 28*a*. In a drilling or screwing mode, blocking element 120*a* exerts a force on snap die 102*a*, which acts on snap die 102 parallel to at least a force of clamping chuck drive shaft 32*a*. The force of blocking element 120*a* is acting on snap die 102*a* via clamping chuck bearing 70*a*, clamping chuck 24*a*, and mounting ring 116*a*. The force of blocking element 120*a* prevents an axial displacement of snap die 102*a* and clamping chuck drive shaft 32*a* during a drilling and screwing mode, and thus prevents an activation of impact-generation unit 50*a*. The force of clamping chuck drive shaft 32*a* has a functionally parallel component which drives snap die 102*a* in rotating fashion during operation. In addition, the force has a functionally and directionally parallel component which spring 56*a* exerts on snap die 102*a* via clamping chuck drive shaft 32*a*.

Figure 4:
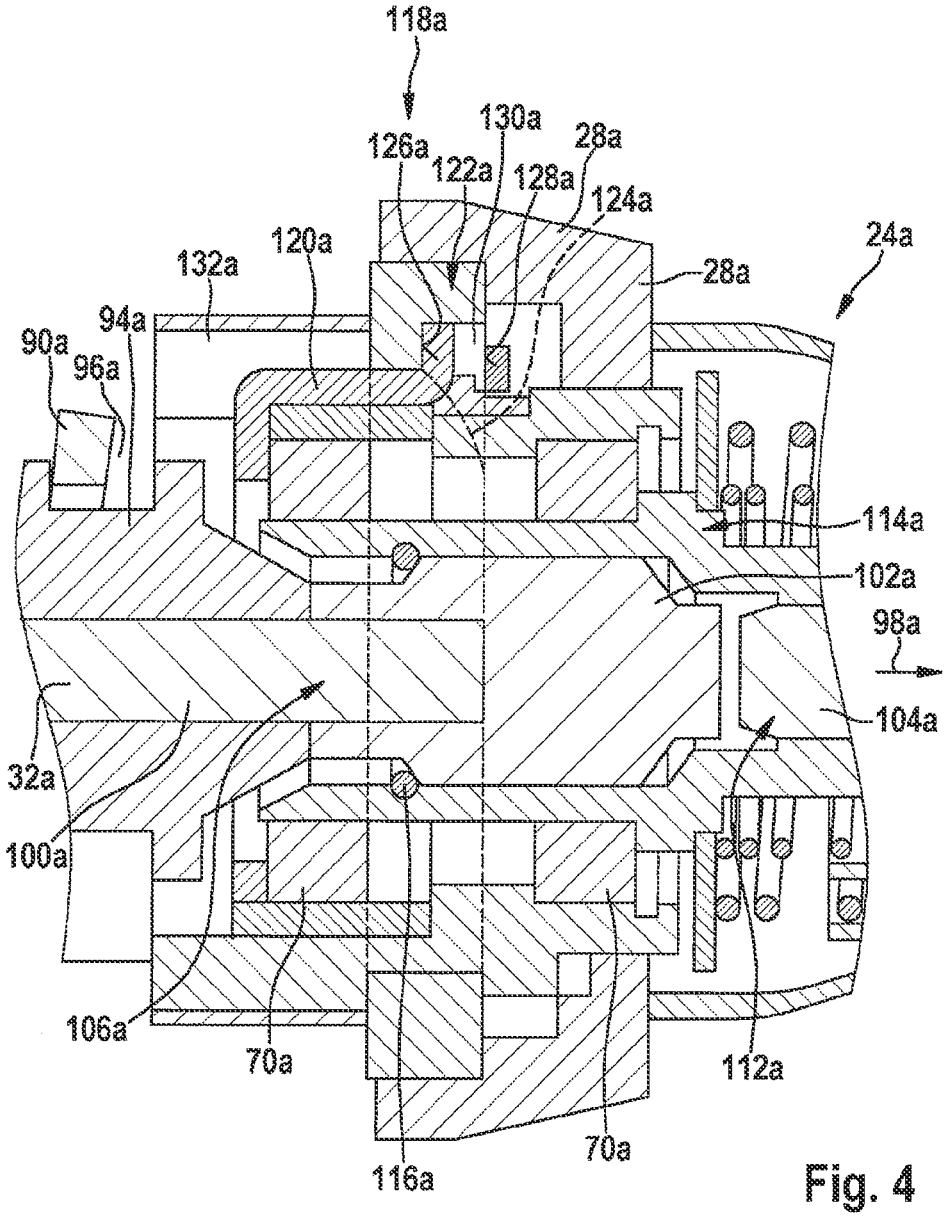
FIG. 4 shows another part-sectional view of the hammer mechanism from FIG. 1, which shows an impact-generation deactivation unit of the hammer mechanism.

FIG. 4 shows a section that runs perpendicularly to the section of FIG. 2 and parallel to strike direction 98*a*, operating element 28*a* being shown in two different positions in the sections of FIGS. 2 and 4. Operating element 28*a* is developed in the form of a ring and encloses the axis of rotation of clamping chuck drive shaft 32*a* in coaxial manner. Operating element 28*a* is mounted so as to be rotatable. It is connected to sliding block guide 122*a* in torsionally fixed manner. Sliding block guide 122*a* is likewise developed in the form of a ring. Sliding block guide 122*a* has a bevel 124*a*, which connects two surfaces 126*a*, 128*a* of sliding block guide 122*a*, Surfaces 126*a*, 128*a* are aligned perpendicularly to strike direction 98*a*. Surfaces 126*a*, 128*a* are disposed in different planes in strike direction 98*a*.

In an impact-drilling mode, blocking element 120*a* is situated inside a recess 130*a*, which, for one, is delimited by bevel 124*a* and one of surfaces 126*a*. This surface 126*a* is situated closer to drive motor 14*a* than the other surface 128*a*. Housing 12*a* includes a housing element 132*a*, which mounts the blocking element in torsionally fixed manner and allows it move in strike direction 98*a*. At the start of an impact-drilling operation, blocking element 120*a*, together with clamping chuck 24*a*, therefore is able to be pushed in a direction counter to the strike direction 98*a*. In an impact-drilling operation, blocking element 120*a* does not exert a blocking force on clamping chuck 24*a*. When operating element 28*a* of impact-generation deactivation unit 118*a* is rotated, blocking element 120*a* is moved in strike direction 98*a* by bevel 124*a*.

In the drilling or screwing mode, blocking element 120*a* is kept in this frontal position. In this way blocking element 120*a* prevents axial shifting of clamping chuck drive shaft 32*a* in the drilling or screwing mode.

FIGS. 5 through 11 show additional exemplary embodiments of the present invention. The following descriptions and the figures are essentially limited to the differences between the exemplary embodiments. Regarding components designated in the same way, particularly regarding components bearing identical reference numerals, it is basically possible to refer also to the drawings and/or the description of the other exemplary embodiments, especially of FIGS. 1 through 4. In order to distinguish the exemplary embodiments, the letter a has been added after the reference numerals of the exemplary embodiment in FIGS. 1 through 4. In the exemplary embodiments of FIGS. 5 through 11, the letter a was replaced by the letters b through e.

Figure 5:
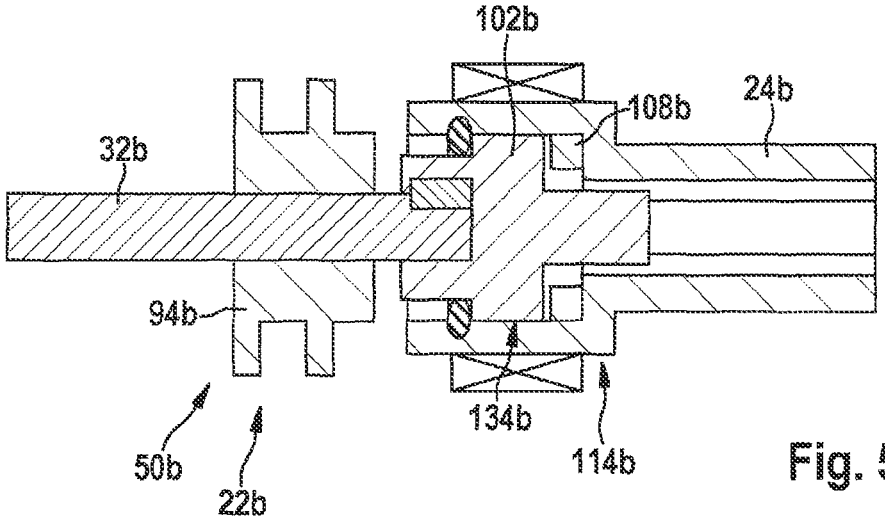
FIG. 5 shows a schematic representation of a first alternative exemplary embodiment of a snap die of the hammer mechanism from FIG. 1.

FIG. 5 shows a portion of a hammer mechanism 22*b*. A hammer means 94*b* of an impact-generation unit 50*b* of hammer mechanism 22*b* is mounted in movable manner on a clamping chuck drive shaft 32*b* of hammer mechanism 22*b*. Clamping chuck drive shaft 32*b* is joined to a snap die 102*b* of hammer mechanism 22*b* in torsionally fixed and axially displaceable manner. Snap die 102*b* is provided with a coupling means 108*b* which forms a torsionally fixed connection to a clamping chuck 24*b* of hammer mechanism 22*b* in at least one operating state. Coupling means 108*b* is situated on a side that is facing a tapered region 114*b* of clamping chuck 24*b* and developed as teething. A sealing region 134*b* of the snap die is resting against clamping chuck 24*b* without gear teeth and advantageously prevents dust from entering impact-generation unit 50*b*.

Figure 6:
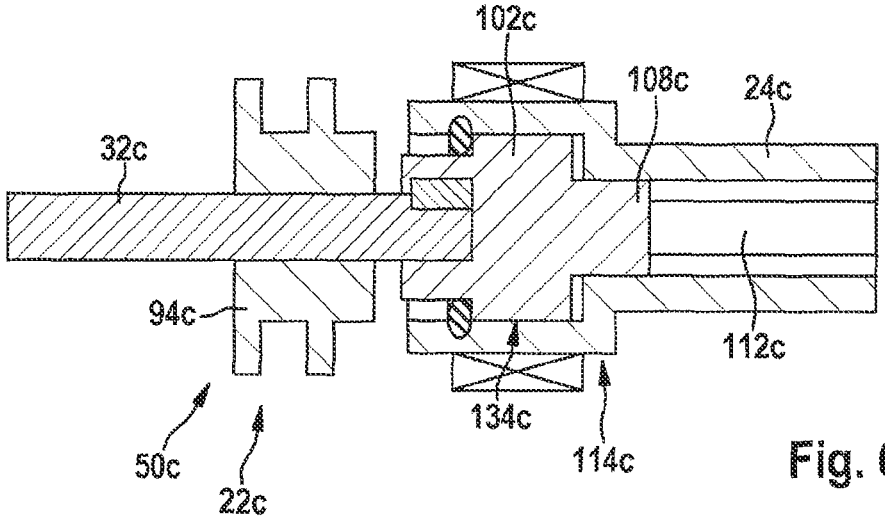
FIG. 6 shows a schematic representation of a second alternative exemplary embodiment of a snap die of the hammer mechanism from FIG. 1.
Figure 7:
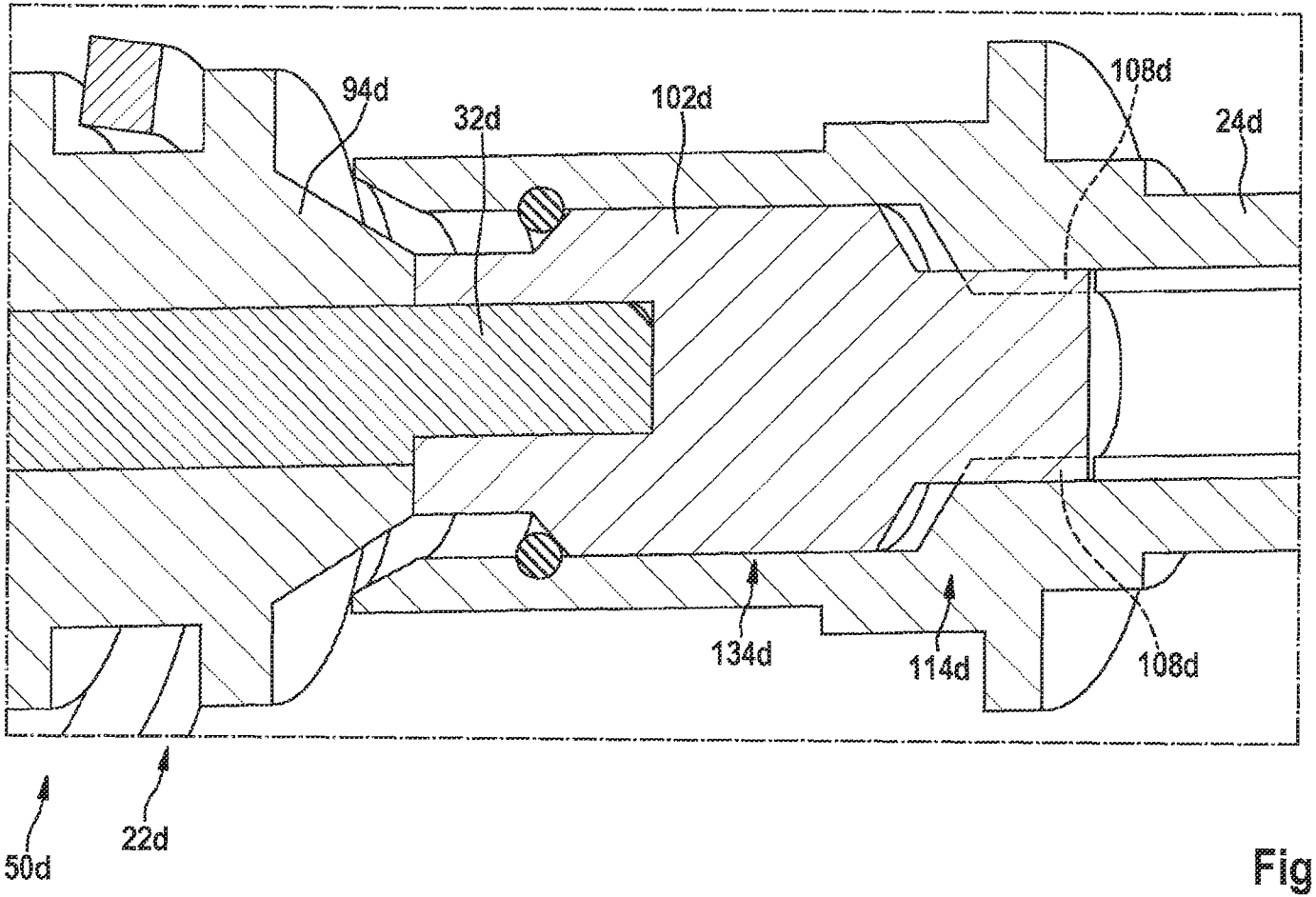
FIG. 7 shows a sectional view of a third alternative exemplary embodiment of a snap die of the hammer mechanism from FIG. 1.
Figure 8:
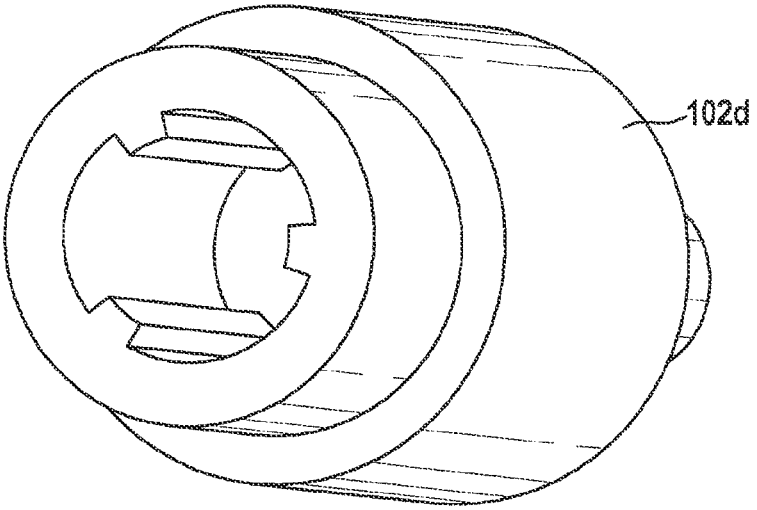
FIG. 8 shows a first perspective view of the snap die from FIG. 7.
Figure 9:
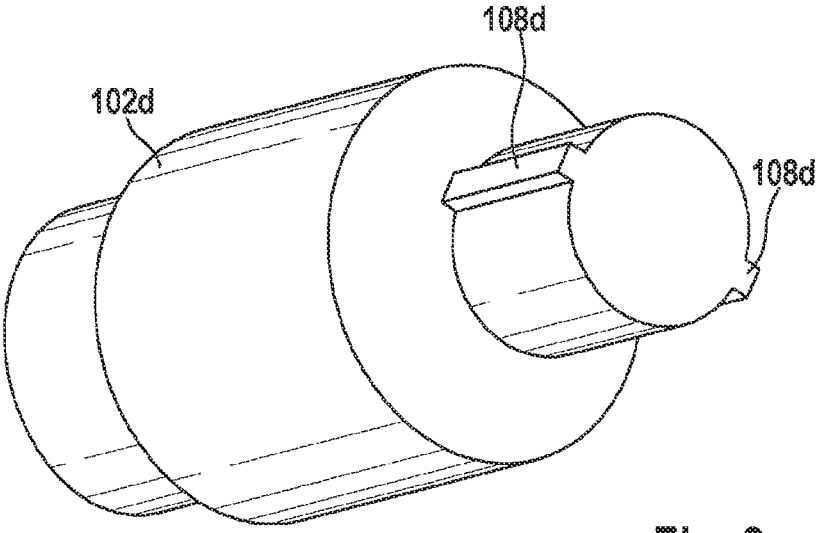
FIG. 9 shows a second perspective view of the snap die from FIG. 7.
Figure 10:
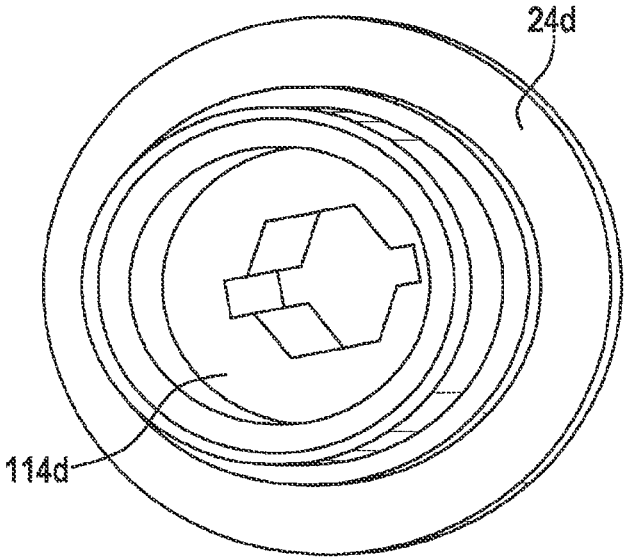
FIG. 10 shows a perspective view of a portion of a clamping chuck of the hammer mechanism of FIG. 7.

FIG. 6, like FIG. 5, schematically illustrates a portion of hammer mechanism 22*c*. A hammer means 94*c* of an impact-generation unit 50*c* of hammer mechanism 22*c* is mounted in movable manner on a clamping chuck drive shaft 32*c* of hammer mechanism 22*c*. Clamping chuck drive shaft 32*c* is joined to a snap die 102*b* of hammer mechanism 22*c* in torsionally fixed and axially displaceable manner. Snap die 102*c* includes a coupling means 108*c* which forms a torsionally fixed connection to a clamping chuck 24*c* of hammer mechanism 22*c* in at least one operating state. Clamping chuck 24*c* is provided with an inserted-tool coupling region 112*c*, with which coupling means 108*c* of snap die 102*c* engages at least partially. The one inserted-tool coupling region 112*c* is provided to apply forces on an inserted tool in the peripheral direction during operation. In an operative state, coupling means 108*c* is at least partially disposed inside a tapered region 114*c* of clamping chuck 24*c*. Coupling means 108*c* is developed in the form of an external hexagon. The dimensions of the external hexagon correspond to the usual dimensions of a bit for a screwing operation. A sealing region 134*c* of the snap die 102*c* rests against clamping chuck 24*c* without gear teeth and advantageously prevents dust from entering impact-generation unit 50*b* in a cost-effective manner. Especially fat loss is able to be minimized.

FIGS. 7 through 10 also show a portion of a hammer mechanism 22*d* as a section and in a perspective view. A hammer means 94*d* of an impact-generation unit 50*d* of hammer mechanism 22*d* is mounted in movable manner on a clamping chuck drive shaft 32*d* of hammer mechanism 22*d*. Clamping chuck drive shaft 32*d* is joined to a snap die 102*d* of hammer mechanism 22*d* in torsionally fixed and axially displaceable manner. Snap die 102*d* includes a coupling means 108*d*, which forms a torsionally fixed connection to a clamping chuck 24*d* of hammer mechanism 22*d* in at least one operating state. In an operative state, coupling means 108*d* is at least partially disposed inside a tapered region 114*d* of clamping chuck 24*d*. Coupling means 108*d* is developed as teething, which includes two coupling ribs that lie opposite each other in relation to the axis of rotation. Coupling means 108*d* has the same form and the same dimensions as a coupling means for the coupling with an inserted tool. The form and the dimensions correspond to those of the SDS Quick standard. A sealing region 134*d* of snap die 102*d* rests against clamping chuck 24*d* without gear teeth.

Figure 11:
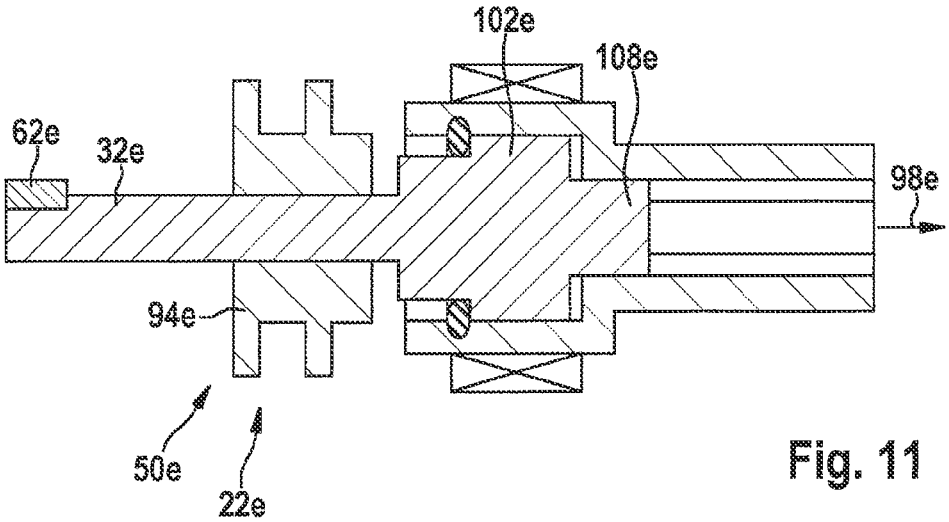
FIG. 11 shows a schematic representation of a fourth alternative exemplary embodiment of a snap die of the hammer mechanism from FIG. 1.

FIG. 11, like FIG. 5, schematically illustrates a portion of hammer mechanism 22*e*. A hammer means 94*e* of an impact-generation unit 50*e* of hammer mechanism 22*e* is movably mounted on a clamping chuck drive shaft 32*e* of hammer mechanism 22*e*. Clamping chuck drive shaft 32*e* is joined to a snap die 102*e* of hammer mechanism 22*e* in torsionally and axially fixed manner. Clamping chuck drive shaft 32*e* and snap die 102*e* are developed in one piece. In an impact, hammer means 94*e* moves both clamping chuck drive shaft 32*e* and snap die 102*e* in strike direction 98*e*. With the aid of a coupling means 62*e*, clamping chuck drive shaft 32*e* is connected in axially displaceable and torsionally fixed manner to a planetary-gear stage described in the exemplary embodiment of FIGS. 1 through 4.

What is claimed is:

1. A hammer mechanism of an apparatus, the hammer mechanism being configured for striking a tool inserted into the apparatus, comprising:

a clamping chuck;

a clamping chuck drive shaft; and a snap die configured to directly strike the inserted tool, wherein the clamping chuck drive shaft is joined to the snap die in a torsionally fixed and axially displaceable manner, wherein the clamping chuck drive shaft is configured to directly act on the snap die, wherein the snap die includes a coupling element for transmitting a rotary motion of the clamping chuck drive shaft to the clamping chuck.

2. The hammer mechanism as recited in claim 1, wherein the clamping chuck includes an inserted-tool coupling region with which the coupling element of the snap die engages at least partially.

3. The hammer mechanism as recited in claim 2, further comprising:

a clamping chuck drive shaft for transmitting a rotary motion to the snap die.

4. The hammer mechanism as recited in claim 3, wherein the clamping chuck drive shaft is at least partially disposed in a recess of the snap die in at least one operating state.

5. The hammer mechanism as recited in claim 2, wherein the snap die includes a sealing region which rests against the clamping chuck without gear teeth.

6. The hammer mechanism as recited in claim 3, further comprising:

a hammer element which is mounted by the clamping chuck drive shaft in a manner allowing movement in a strike direction in at least one operating state.

7. The hammer mechanism as recited in claim 6, wherein the clamping chuck drive shaft at least partially penetrates the hammer element.

8. The hammer mechanism as recited in claim 6, wherein the hammer element is configured to provide a strike pulse in the strike direction.

9. The hammer mechanism as recited in claim 6, wherein the strike direction is an axial strike direction.

10. The hammer mechanism as recited in claim 3, further comprising:

an impact-generation deactivation unit having a blocking element which acts on the snap die parallel to a force of the clamping chuck drive shaft, in at least a drilling operation.

11. The hammer mechanism as recited in claim 3, further comprising:

a planetary gearing which drives the clamping chuck drive shaft in at least one operating state.

12. The hammer mechanism as recited in claim 3, further comprising:

an impact-generation unit; and a coupling element which is connected to the clamping chuck drive shaft in a torsionally-fixed manner and drives the impact-generation unit.

13. The hammer mechanism as recited in claim 1, wherein the snap die is mounted to the clamping chuck in an axially movable manner.

14. A hand-held tool, comprising:

an inserted tool element; and a hammer mechanism having a clamping chuck, a clamping chuck drive shaft, and a snap die configured to directly strike the inserted tool element, wherein the clamping chuck drive shaft is joined to the snap die in a torsionally fixed and axially displaceable manner, wherein the clamping chuck drive shaft is configured to directly act on the snap die, and wherein the snap die includes a coupling element for transmitting a rotary motion of the clamping chuck drive shaft to the clamping chuck.

15. A hammer mechanism of an apparatus, the hammer mechanism being configured for striking a tool inserted into the apparatus, comprising:

a clamping chuck;

a snap die configured to directly strike the inserted tool;

a clamping chuck drive shaft for transmitting a rotary motion to the snap die; and a hammer element which is mounted by the clamping chuck drive shaft in a manner allowing movement in a strike direction in at least one operating state, wherein the snap die includes a coupling element for transmitting a rotary motion to the clamping chuck, wherein the clamping chuck drive shaft at least partially penetrates the hammer element.

16. A hammer mechanism of an apparatus, the hammer mechanism being configured for striking a tool inserted into the apparatus, comprising:

a clamping chuck;

a snap die configured to directly strike the inserted tool;

a clamping chuck drive shaft for transmitting a rotary motion to the snap die; and an impact-generation deactivation unit having a blocking element which acts on the snap die parallel to a force of the clamping chuck drive shaft, in at least a drilling operation, wherein the snap die includes a coupling element for transmitting a rotary motion to the clamping chuck.

* * * * *